US006712982B2

(12) United States Patent
Bohn et al.

(10) Patent No.: US 6,712,982 B2
(45) Date of Patent: Mar. 30, 2004

(54) METHOD OF REMOVING CATALYST PARTICLES FROM WAX

(75) Inventors: Mark S. Bohn, Golden, CO (US); James E. Siebarth, Denver, CO (US)

(73) Assignee: Rentech, Inc., Denver, CO (US)

( * ) Notice: Subject to any disclaimer, the term of this patent is extended or adjusted under 35 U.S.C. 154(b) by 0 days.

(21) Appl. No.: 10/417,107

(22) Filed: Apr. 17, 2003

(65) Prior Publication Data

US 2003/0205516 A1 Nov. 6, 2003

Related U.S. Application Data

(62) Division of application No. 09/871,148, filed on May 29, 2001.

(51) Int. Cl.[7] ..... B01D 21/00

(52) U.S. Cl. ..... 210/802; 210/521; 210/522; 518/709; 518/728

(58) Field of Search ..... 210/802, 521, 210/522; 518/709, 728

(56) References Cited

U.S. PATENT DOCUMENTS

| | | | |
|---|---|---|---|
| 2,718,308 | A | 9/1955 | Le Bus |
| 5,510,393 | A | 4/1996 | Coffman |
| 6,068,760 | A | 5/2000 | Benham et al. |

FOREIGN PATENT DOCUMENTS

| | | |
|---|---|---|
| EP | 0305203 | 3/1989 |

*Primary Examiner*—Robert J. Popovics
(74) *Attorney, Agent, or Firm*—Shoemaker and Mattare

(57) ABSTRACT

Catalyst particles are separated from the wax in a reactor slurry reactor by feeding a portion of the slurry to a dynamic settler. Heavier catalyst particles settle and are removed as the slurry at the bottom of the settler is recycled back to the reactor. Clarified wax is removed at the top of the settler. A multi-channel baffle prevents turbulence, improving retention of the desired heavier catalyst particles.

6 Claims, 4 Drawing Sheets

METHOD OF REMOVING CATALYST PARTICLES FROM WAX

This application is a divisional of U.S. application Ser. No. 09/871,148, filed May 29, 2001.

BACKGROUND OF THE INVENTION

1. Field of the Invention

This invention relates to processes in which a catalyst powder is suspended in a liquid.

2. Description of the Prior Art

In a slurry reactor, for example, one in which a mixture of hydrogen and carbon monoxide is reacted on a powdered catalyst to form liquid hydrocarbons and waxes, the slurry is maintained at a constant level by continuously or intermittently removing wax from the reactor. The catalyst in the wax must be separated from the slurry and returned to the reactor to maintain a constant inventory of catalyst in the reactor. In order to keep the catalyst losses within the replacement rate due to deactivation, the wax removed from the system must not contain more than about 0.5% catalyst by weight.

Several devices have been proposed for separating the catalyst from the wax including centrifuges, cross-flow sintered metal filters, wire mesh filters, and magnetic separators. Centrifuges are unable to reduce the catalyst concentration below about 1% and are complex, costly, and difficult to maintain. Sintered metal and wire mesh filters have been found to irreversibly plug. Magnetic filters typically can not process fluids with greater than about 0.5% solids.

U.S. Pat. No. 6,068,760, which is incorporated into this document by reference, describes a dynamic settler for separating catalyst from the reactor slurry. The dynamic settler provides several advantages over other separation methods including: (i) it does not require backwashing, (ii) it operates continuously, (iii) it does not require costly filter media, (iv) it is relatively simple and cost effective and (v) it can not plug. However, for plants that produce wax at a rate greater than about 0.25 gpm, the size of the settler must be increased to the point where natural convection begins to have a negative effect.

Natural convection is driven by buoyancy forces that arise due to temperature differences. The parameter that relates this driving force to the viscous retarding force is the Grashof number, which is proportional to diameter cubed. Thus, increasing the settler diameter dramatically increases the effect of natural convection. Tests in large vessels, six to fourteen feet in diameter with Fischer Tropsch slurries have shown that it is not possible to separate the catalyst and molten wax by settling. The solution to this problem has been to use many small settlers in parallel which can quickly become impractical.

SUMMARY OF THE INVENTION

An object of the invention is to provide an improved apparatus for separating wax and catalyst whereby relatively clean wax can be removed from the slurry reactor and the catalyst can be returned to the reactor without being subjected to attrition from a mechanical pump.

Another object is to prevent natural convection flows in large-scale dynamic settlers.

Other objects will become apparent as the description of the invention proceeds.

With this invention, a portion of a slurry containing wax and catalyst is passed from a reactor to a dynamic settler, which defines a closed chamber. A vertical feed conduit extends downwardly into the chamber for a substantial distance, forming an annular region between the inner walls of the chamber and the feed conduit. A slurry removal outlet at the bottom of the settler chamber returns slurry back to the reactor. As the slurry flows through the settler, the heavier catalyst particles settle out and are removed as the slurry at the bottom of the settler is recycled back to the reactor. Clarified wax rises up in the annular section and is removed by a wax outlet pipe at the top.

According to this invention, the annular region within the settler is substantially filled with a baffle that defines a great number of parallel channels. By making the cross-section of each channel sufficiently small, one minimizes natural convection flow which would tend to keep the catalyst particles suspended in the wax.

DESCRIPTION OF THE PREFERRED EMBODIMENTS

Figure 1:
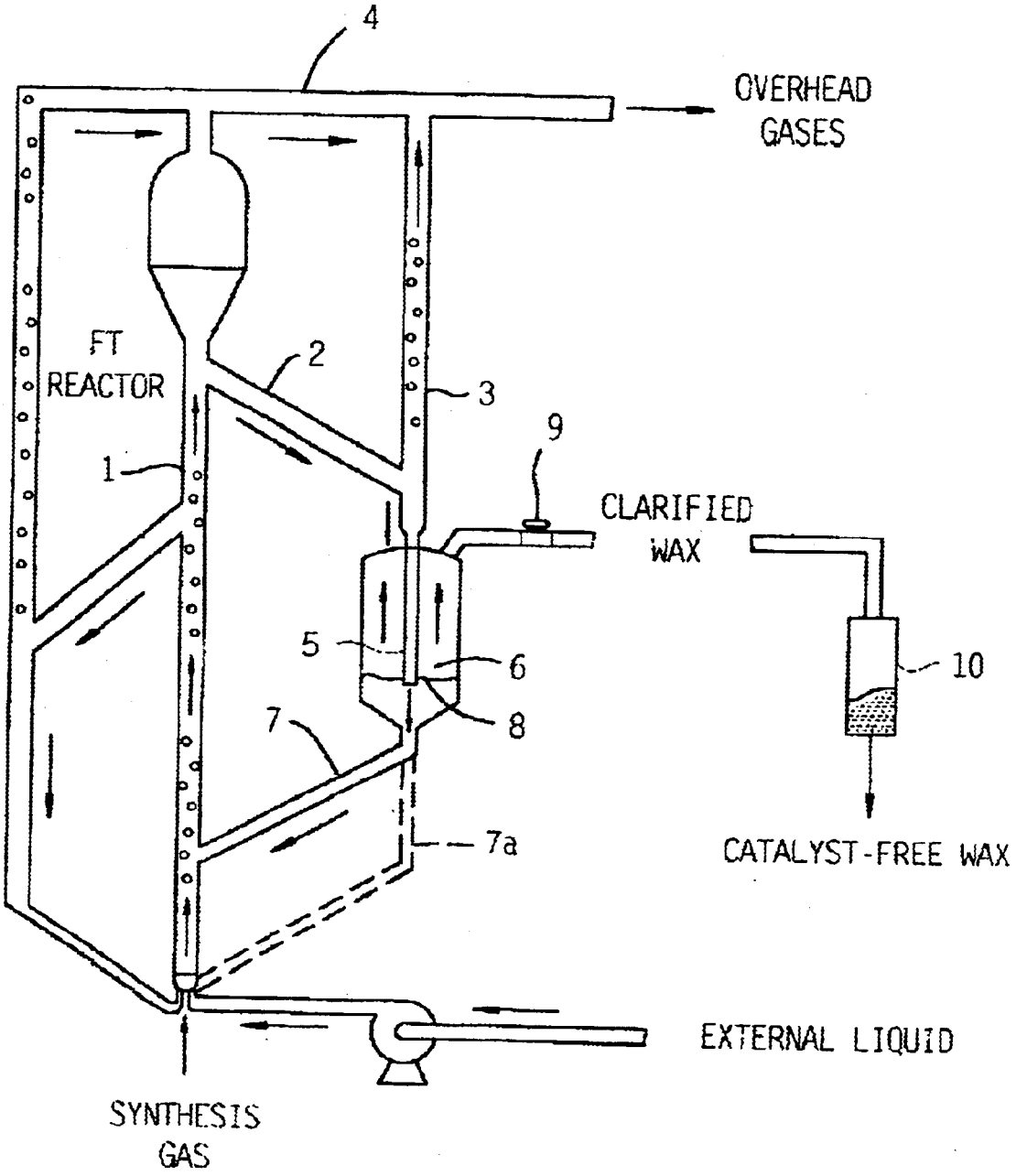
FIG. 1 (PRIOR ART)
FIG. 1, which corresponds to FIG. 1 in U.S. Pat. No. 6,068,760, illustrates a slurry reactor and an adjacent dynamic settler for separating catalyst and wax.

In the system shown in FIG. 1, the three-phase mixture in slurry reactor 1 (sometimes referred to as a bubble column reactor) flows into overflow pipe 2 and thence to vertical disengaging pipe 3. Gas bubbles flow upward in the gas disengaging pipe into reactor outlet pipe 4. The liquid phase and solid catalyst particles flow downward in the disengaging pipe and enter pipe 5 which extends along the centerline of the cylindrical dynamic settler 6 for about 80% of the height of settler. The slurry exits pipe 5 as a free jet which flows into the exit opening of the settler and returns to the reactor through pipe 7. The annular region 8 surrounding pipe 5 contains wax which is essentially free from catalyst particles since the particles (which are much more dense than the wax) would have to reverse direction in order to flow upward in the annular region. A valve 9 located at the top of settler 6 controls the rate of wax removal from the settler. Flow through the settler is maintained by natural circulation created by the difference in hydrostatic head between the gas-free slurry in settler 6 and the bubbly flow in reactor 1.

The efficacy of the device in removing catalyst particles from the slurry is due in part to the momentum of the jet issuing from pipe 5. This momentum carries the particles into pipe 7 in a direction opposite to that of the wax being removed from the device. Therefore, the particles are moved downward not only by gravity, but also by the jet momentum. Some catalyst particles can escape the jet due to turbulence in the shear layer between the jet and the quiescent fluid surrounding the jet. If these particles are subsequently entrained in the upflow and if they are sufficiently large, they will be separated by gravity.

The clarity of the wax being removed is affected by the upward velocity of the wax in the annular region 8: a lower upflow velocity entrains fewer particles than a higher upflow velocity, due to lower drag force on the particles. All other factors being equal, a large settler diameter will produce better results (i.e., clearer wax) because the upflow velocity is less and more catalyst particles will fall.

Testing has shown that for a catalyst with particles greater than about 6 micron, it is possible to produce wax with a solids content of less than 0.5% if the upward velocity in the settler is kept to a maximum of about 30–60 cm/hr. In many applications it will be necessary to produce much cleaner wax, for example, when the wax needs to undergo further processing such as hydrotreating. To reduce the solids content of the wax well below 0.5%, a magnetic filter or similar device will be required for secondary filtration. Such devices lose efficiency when they are fed fluids with greater than about 0.5% solids. Thus, in order to keep the catalyst losses to an acceptably tow level and to retain the efficiency of the secondary filter, the upward velocity in the settlers must be kept below about 60 cm/h. For a high wax production reactor, this low upward velocity requirement forces one to use a large-diameter settler, with its inherent natural convection problems.

Figure 3:
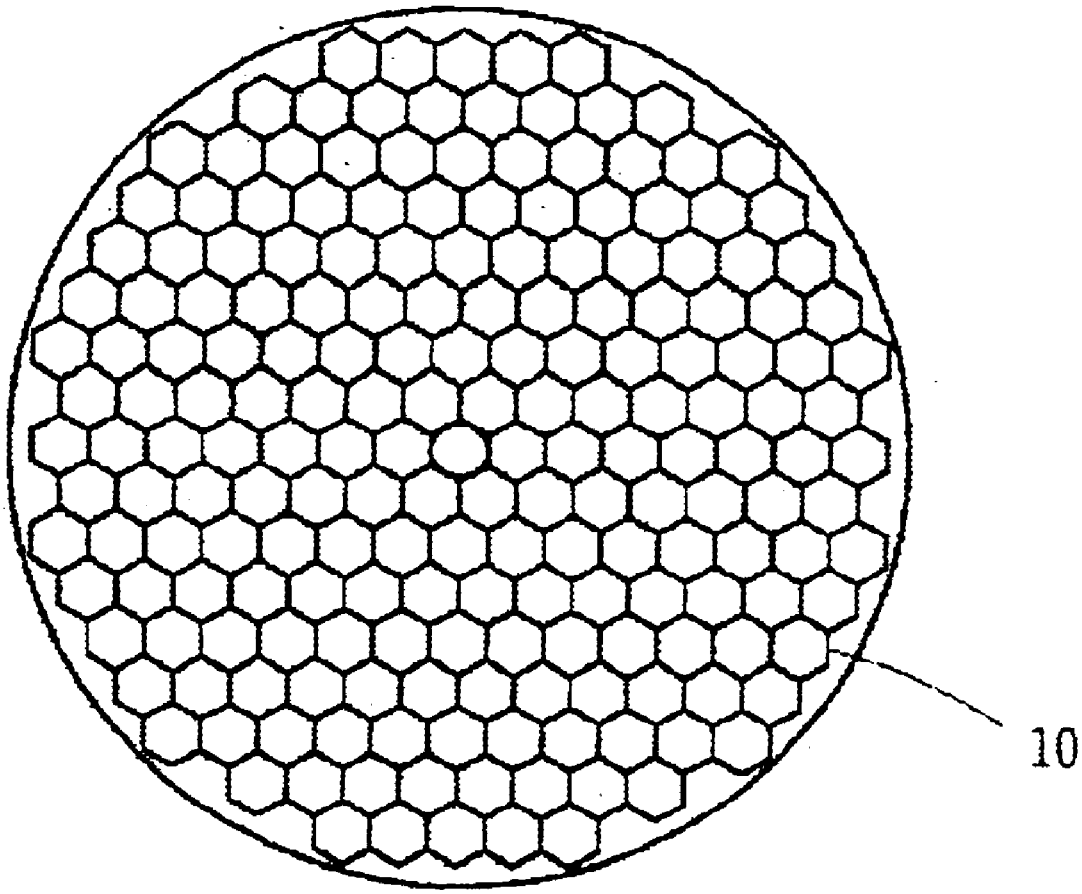
FIG. 3 is a sectional view taken on horizontal plane 3—3 in FIG. 2.

This invention provides the settler with internal baffles that subdivide the annular region into a large number of small-dimension channels, so that single large-diameter settler may be used in high volume applications. FIG. 3 best shows the baffle structure 10, which is preferably of uniform cross-section.

The baffles may be made from sheet metal because they are not structural and do not contain pressure. They may be either extruded or bent to form passages of the desired shape. A hexagonal shape is preferred because it efficiently fills the annular region, but other polygonal or round shapes may be used. The baffle shown in FIG. 3 has 111 hexagonal is cells in a 4 foot diameter settler.

Figure 2:
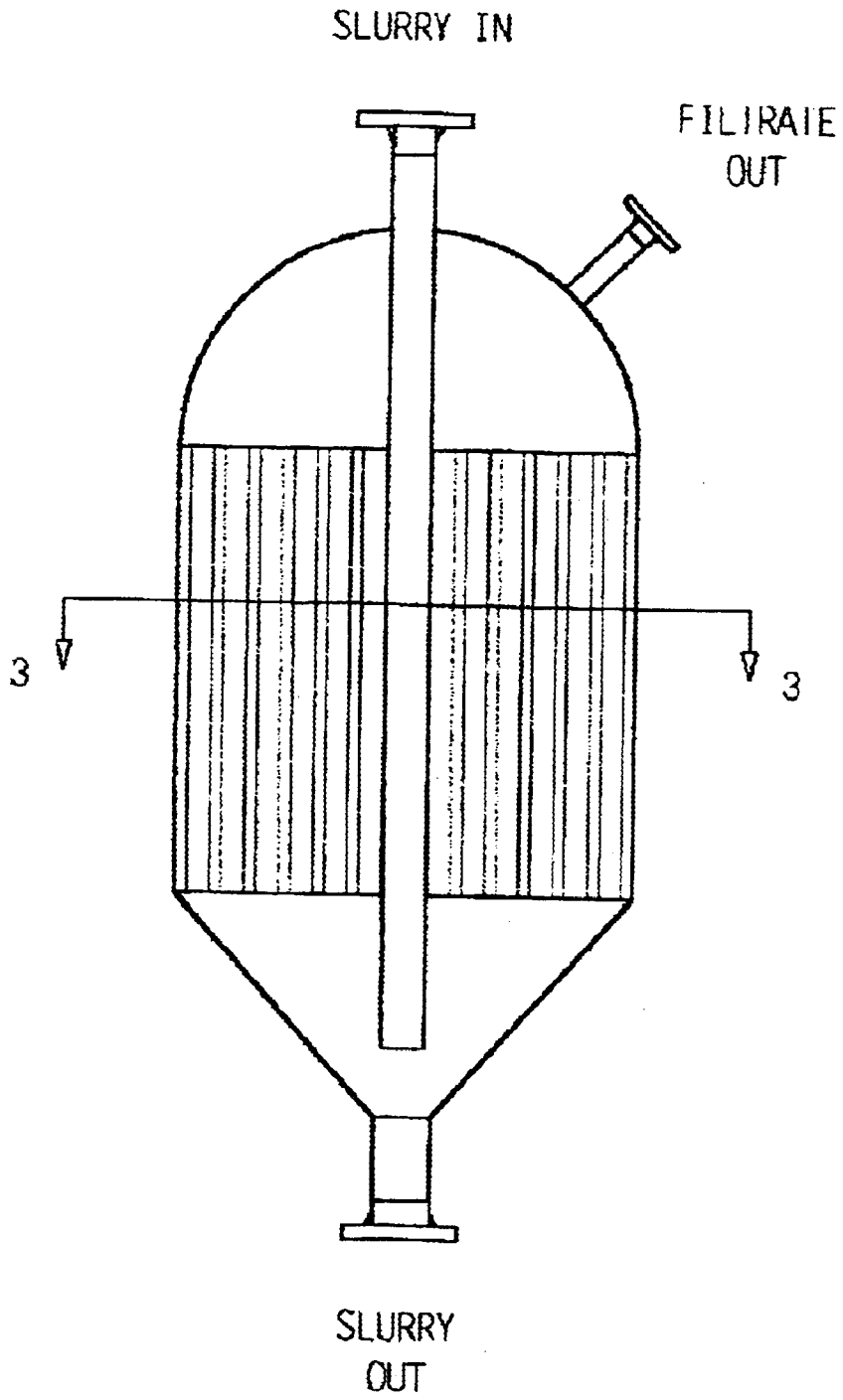
FIG. 2 is a vertical cross-section through a dynamic settler embodying the invention.

In operation, slurry is introduced into the main vessel (FIG. 2) through the inlet pipe, which terminates at about 80% of the distance from top to bottom. The internal baffle structure provides two benefits: subdivision of a commercial-scale settler into small channels which reduce natural convection, and the addition of surface area that promotes sedimentation. The flow channels may be inclined from the vertical because this enhances the effect of the additional surface area by shortening the vertical distance that the particles must fall, often called Lamella sedimentation.

Laminar flow (a Reynolds number well below 10,000) should be maintained in the slurry inlet pipe, if possible, to minimize mixing as the slurry jet enters the settler. With a slurry inlet pipe of about 4 inch inside diameter, the Reynolds number will be about 6,000 at a slurry flow rate of about 50 gal/min. If the upflow velocity is limited to 60 cm/hr, the clean wax flow rate will be 3 gpm for a 4-foot diameter settler and will scale proportionally to the square of the settler diameter. The slurry feed rate to the settler is typically 10 to 20 times the clarified wax removal rate.

The shape of the bottom of the settler, i.e. the transition from the cylindrical section to the slurry outlet pipe, can affect performance. A sudden decrease in vessel diameter will encourage recirculation cells to form as the slurry jet approaches the slurry outlet pipe. Also, catalyst particles will tend to settle and collect on the near-horizontal surfaces. Therefore, there should be a gradual diameter change from the main vessel diameter to the slurry outlet pipe. For this reason and due to manufacturing constraints, a frustoconical bottom is preferred.

The slurry outlet nozzle is larger than the slurry inlet pipe to further minimize recirculation as the slurry jet leaves the settler. For example, a four-inch inlet pipe may be used in conjunction with a six-inch outlet.

It is important that the settler be uniformly heated. A steam jacket or steam coil applied uniformly to the outer surface will ensure that the wax inside the vessel is maintained at a uniform high temperature. This uniform high temperature will further reduce the effects of natural convection and keep the viscosity low to improve separation. Ideally the entire contents of the settler should be maintained at a temperature of about 10° C. below that of the reactor. This differential reduces chemical reactions on the catalyst in the vessel without significantly increasing viscosity.

Figure 4:
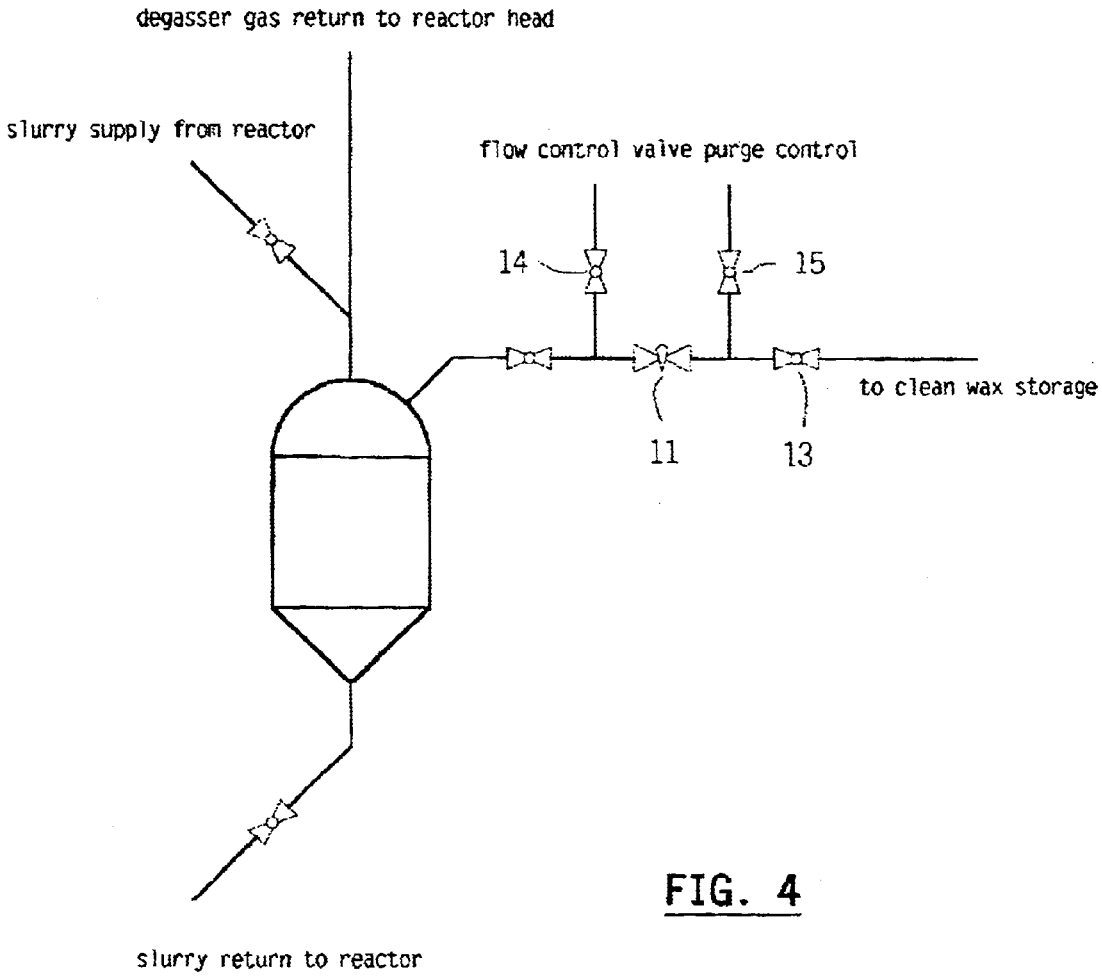
FIG. 4 is a schematic of the settler and its piping.

FIG. 4 shows the slurry supply from the reactor, the slurry return to the reactor, and the gas return from the degasser to the reactor head. The clean wax flow control valve 11 is shown on the right side of the figure. An additional feature is the ability to clean this valve with minimum disruption to the process. It can be expected that the clean wax will contain fine catalyst and carbon particles and that these particles can build up inside the clean wax control valve inhibiting the ability to accurately control flow of the clean wax. The block and purge valves 12,13,14,15 shown in FIG. 4 allow a purge fluid such as an oil to be forced through the flow control valve in either direction during a run without contaminating the clean wax with the purge fluid and with minimal disruption to the settler operation. To clean the flow control valve 11, the valves 12 and 13 are closed, and then the valves 14 and 15 are opened to allow a purging fluid under pressure to pass through the flow control valve.

The foregoing detailed description is given merely by way of illustration. Many variations may be made therein without departing from the spirit of this invention. In particular, while the example describes clarifying wax in a Fischer-Tropsch process, the invention is also useful for clarifying wax in other types of processes.

We claim:

1. A method for removing catalyst particles from wax in a reaction slurry produced in a Fischer-Tropsch reactor, said method comprising steps of passing said slurry through a vessel having a wall defining a chamber having an upper end and a lower end, an inlet pipe entering the vessel at said upper end and defining an annular volume between the vessel wall and the inlet pipe, a slurry recirculation pipe attached to said vessel and communicating with the chamber at said lower end, a multichannel baffle within said annular volume and fully occupying said annular volume, and a wax removal pipe communicating with said annular volume above said baffle, said baffle dividing said annular volume into plural channels under process conditions which minimize natural flows in the baffle so as to promote settling of particles from the slurry.

2. The invention of claim 1, wherein substantially all of said channels have identical cross-sectional shape and size.

3. The invention of claim 2, wherein said cross-sectional shape is hexagonal.

4. The invention of claim 2, wherein said cross-sectional shape is circular.

5. The invention of claim 2, wherein said cross-sectional shape has a maximum dimension of about four inches.

6. The invention of claim 1, wherein said process conditions are chosen to produce a Reynolds number of less than 10,000 within said baffle.

* * * * *